US010689910B2

(12) United States Patent
Dadkhah et al.

(10) Patent No.: US 10,689,910 B2
(45) Date of Patent: Jun. 23, 2020

(54) BI-DIRECTIONAL DRILLING SYSTEMS AND METHODS

(71) Applicant: Schlumberger Technology Corporation, Sugar Land, TX (US)

(72) Inventors: Siamak Dadkhah, Steonehouse (GB); Geoffrey Charles Downton, Minchinhampton (GB); Adam Ian Bowler, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 220 days.

(21) Appl. No.: 15/627,982

(22) Filed: Jun. 20, 2017

(65) Prior Publication Data

US 2018/0002985 A1 Jan. 4, 2018

Related U.S. Application Data

(60) Provisional application No. 62/356,642, filed on Jun. 30, 2016.

(51) Int. Cl.

| | |
|---|---|
| ***E21B 44/04*** | (2006.01) |
| ***E21B 7/06*** | (2006.01) |
| ***E21B 10/00*** | (2006.01) |
| ***E21B 7/00*** | (2006.01) |
| *E21B 10/26* | (2006.01) |
| *E21B 10/10* | (2006.01) |

(52) U.S. Cl.

CPC ..... *E21B 7/064* (2013.01); *E21B 7/00* (2013.01); *E21B 10/003* (2013.01); *E21B 44/04* (2013.01); *E21B 10/10* (2013.01); *E21B 10/26* (2013.01)

(58) Field of Classification Search

CPC combination set(s) only.
See application file for complete search history.

(56) References Cited

U.S. PATENT DOCUMENTS

| | | | | | |
|---|---|---|---|---|---|
| 3,477,340 | A * | 11/1969 | Faugli | B23C 5/00 | 407/45 |
| 3,840,080 | A * | 10/1974 | Berryman | E21B 4/02 | 175/107 |
| 3,866,678 | A * | 2/1975 | Jeter | E21B 4/04 | 166/66 |
| 4,876,886 | A * | 10/1989 | Bible | E21B 12/02 | 73/152.45 |
| 5,107,940 | A * | 4/1992 | Berry | E21B 7/023 | 175/122 |
| 5,394,951 | A * | 3/1995 | Pringle | E21B 4/18 | 175/61 |
| 8,109,349 | B2 | 2/2012 | Hall et al. | | |
| 8,739,903 | B2 * | 6/2014 | Denoix | E21B 10/62 | 175/381 |
| 8,960,337 | B2 | 2/2015 | Hall et al. | | |
| 9,290,995 | B2 * | 3/2016 | Boone | E21B 7/24 | |

(Continued)

FOREIGN PATENT DOCUMENTS

WO WO2014099783 A1 6/2014

*Primary Examiner* — Taras P Bemko
*Assistant Examiner* — Ronald R Runyan

(57) ABSTRACT

A method for removing material with a bit includes rotating a bit in a first direction, changing the rotational direction and rotating the bit in an opposing second direction. Rotation of the bit in the first direction and rotation of the bit in the second direction both remove material.

19 Claims, 10 Drawing Sheets

(56) References Cited

U.S. PATENT DOCUMENTS

| | | | | |
|---|---|---|---|---|
| 2001/0003318 | A1* | 6/2001 | Hulkkonen | E21B 10/003 175/415 |
| 2004/0168827 | A1* | 9/2004 | Jeffryes | E21B 44/00 175/48 |
| 2014/0305702 | A1* | 10/2014 | Bowley | E21B 44/04 175/27 |
| 2015/0354280 | A1 | 12/2015 | Downton et al. | |

* cited by examiner

BI-DIRECTIONAL DRILLING SYSTEMS AND METHODS

CROSS-REFERENCE TO RELATED APPLICATIONS

This application claims priority to and the benefit of U.S. Provisional Application No. 62/356,642, filed on Jun. 30, 2016, the entirety of which is incorporated herein by reference.

BACKGROUND

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods and tools may be utilized depending partly on the characteristics of the formation through which the wellbore is drilled.

A drilling system may use a variety of bits in the creation, maintenance, extension, and abandonment of a wellbore. Bits include drilling bits, mills, reamers, hole openers, and other cutting tools. Some drilling systems rotate a bit relative to the wellbore to remove material from the sides and/or bottom of the wellbore. Some bits are used to remove natural material from the surrounding geologic formation to extend or expand the wellbore. Some bits are used to remove material positioned in the wellbore during construction or maintenance of the wellbore. For example, bits are used to remove concrete and/or metal casing from a wellbore during maintenance, creation of a window for lateral drilling in an existing wellbore, or during remediation.

Rotation of the bit relative to the wellbore allows cutting elements on the bit to mechanically remove material from the sides and/or bottom of the wellbore. The engagement between the bit and the sides and/or bottom of the wellbore imparts a torque on the bit. In a conventional drilling system, the torque builds in a length of the drill string similar to a torsional spring. When the stored energy is released, the drill string slips at high rotational speeds. Slipping wastes energy previously transmitted downhole (thereby slowing drilling rates), risks damage to the equipment, and risks injury to operators.

Whirling is the lateral movement of the drill string within a wellbore and can be a harmonic behavior that builds over time. Whirling wastes energy previously transmitted downhole (thereby slowing drilling rates) and can impart high lateral forces on the drill string that can damage the drill string or components connected thereto.

SUMMARY

In some embodiments, a method of removing material with a bit includes rotating the bit in a first rotational direction for a first duration of time; removing material from a wellbore surface in the first duration of time; reversing a rotational direction of the bit; rotating the bit in a second rotational direction for a second duration of time; and removing material from the wellbore surface in the second duration of time.

In some embodiments, a method of applying torque to a drilling tool assembly includes applying a first torque to a portion of a drilling tool assembly in a first direction for a first duration of time; applying a second torque to the portion of a drilling tool assembly in the first direction for a second duration of time; applying a third torque to the portion of a drilling tool assembly in a second direction for a third duration of time; and applying a fourth torque to the portion of a drilling tool assembly in the second direction for a fourth duration of time.

In some embodiments, a system for rotating a bit includes a drilling tool assembly and a kelly or top drive. The drilling tool assembly includes a drill string and a bit connected at an end of the drill string. The kelly or top drive is configured to alternately apply a drive torque to the drilling tool assembly in a first rotational direction and in an opposing second rotational direction.

This summary is provided to introduce a selection of concepts that are further described in the detailed description, and is not intended to identify key or essential features of the claimed subject matter, nor is it intended to be used as an aid in limiting the scope of the claimed subject matter. Additional features and aspects of embodiments of the disclosure will be set forth in the description that follows. These and other features will become more fully apparent from the following description and appended claims, or may be learned by the practice of such embodiments as set forth herein.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 6-1 is a chart of an embodiment of a rotational velocity profile, according to the present disclosure;

FIG. 6-2 is a chart of another embodiment of a rotational velocity profile, according to the present disclosure;

DETAILED DESCRIPTION

This disclosure generally relates to devices, systems, and methods for removing material from a formation. In some embodiments, the present disclosure relates to drilling systems for rotating a bit in alternating rotational directions to improve efficiency, reduce the likelihood of cutting element or bit body failure, or combinations thereof. While a drill bit for cutting through an earth formation is described herein, it should be understood that the present disclosure may be applicable to other bits such as mills, reamers, hole openers, and other bits used in downhole or other applications.

Figure 1:
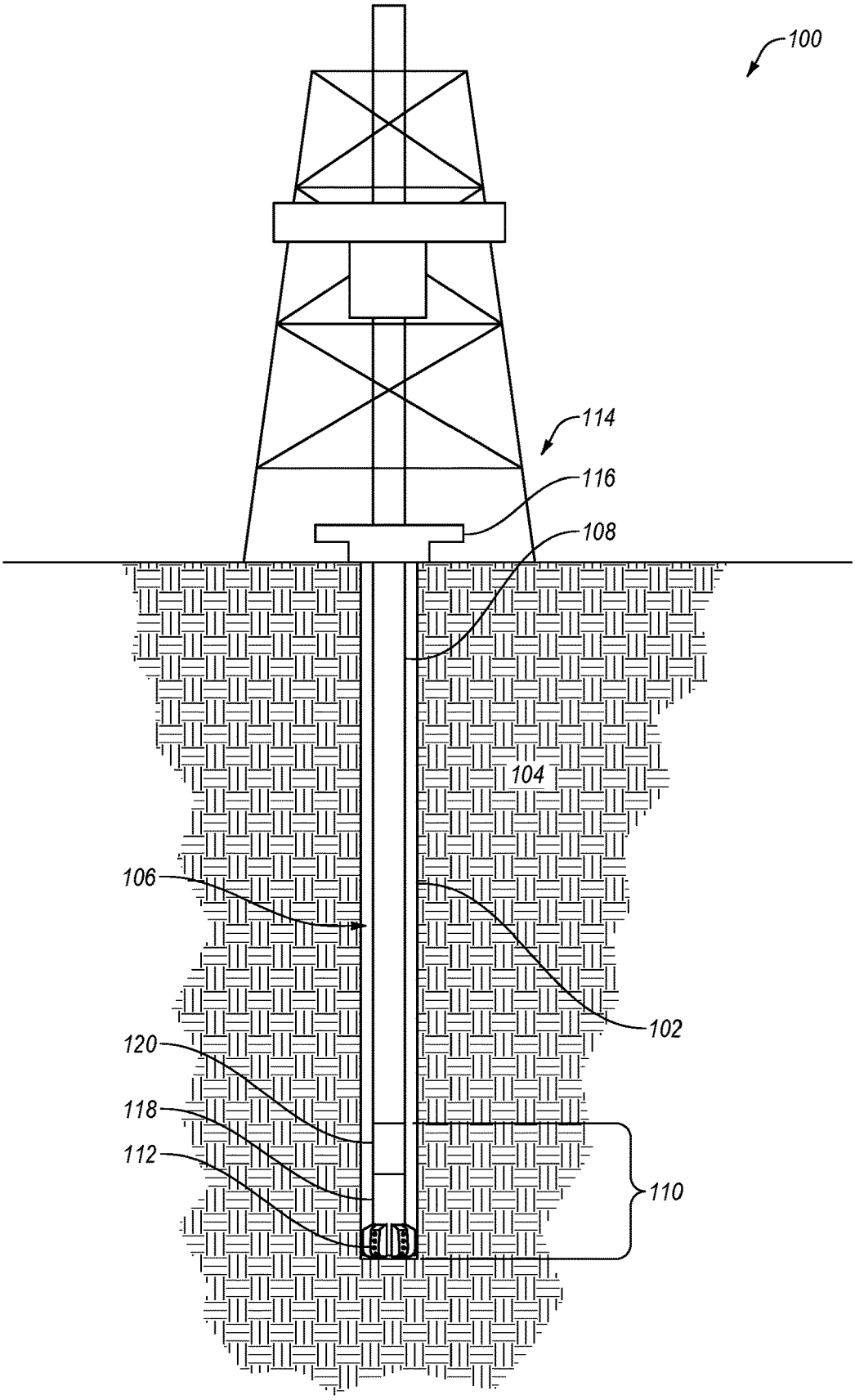
FIG. 1 is a schematic representation of an embodiment of a drilling system, according to the present disclosure.

FIG. 1 shows one example of a drilling system 100 for forming a wellbore 102 in an earth formation 104. The drilling system 100 includes a drilling tool assembly 106 which extends downward into the wellbore 102. The drilling tool assembly 106 may include a drill string 108 and a bottomhole assembly ("BHA") 110 attached to a downhole end portion of drill string 108. The BHA 110 may include a bit 112 for drilling, milling, reaming, or performing other cutting operations within the wellbore.

The drill string 108 may include several joints of drill pipe connected end-to-end through tool joints. The drill string 108 transmits drilling fluid through a central bore and optionally transmits rotational power from the drill rig 114 to the BHA 110. In some embodiments, the drill string 108 may further include additional components such as subs, pup joints, etc. The drill string 108 may include slim drill pipe, coiled tubing, or other materials that transmit drilling fluid through a central bore, which may not transmit rotational power. Where rotational power is used, a downhole motor (e.g., a positive displacement motor, turbine-driven motors, electric motor, etc.) may be included in the BHA 110. The drill string 108 provides a hydraulic passage through which drilling fluid is pumped from the surface. The drilling fluid discharges through nozzles, jets, or other orifices in the bit 112 (or other components of the drill string 108 or BHA 110) for cooling the bit 112 and cutting structures thereon, for lifting cuttings out of the wellbore 102 as downhole operations are performed, or for other purposes (e.g., cleaning, powering a motor, etc.).

The rig 114 may provide rotational power to rotate the drilling tool assembly 106 through a kelly or top drive 116 at the surface of the wellbore 102. The kelly/top drive 116 mechanically engages with the drill string 108 or other portion of the drilling tool assembly 106 and provides a drive torque. The drive torque is then transmitted downhole by the drilling tool assembly 106 toward the BHA 110.

The BHA 110 may include the bit 112 or other components. An example BHA 110 may include additional or other components (e.g., coupled between to the drill string 108 and the bit 112). Examples of additional BHA components include drill collars; stabilizers 118; measurement-while-drilling ("MWD") tools, logging-while-drilling ("LWD") tools, or other measurement tools 120, downhole motors, underreamers, section mills, hydraulic disconnects, jars, vibration or dampening tools, other components, or combinations of the foregoing. For example, the other measurement tools 120 may include accelerometers to measure the movement of the bit 112 and/or a torque meter to measure forces on the bit 112.

In general, the drilling system 100 may include other drilling components and accessories, such as special valves (e.g., kelly cocks, blowout preventers, and safety valves). Additional components included in the drilling system 100 may be considered a part of the drilling tool assembly 106, the drill string 108, or a part of the BHA 110 depending on their locations or functions in the drilling system 100.

The bit 112 in the BHA 110 may be any type of bit suitable for degrading downhole materials, such as removing material from a wellbore surface. For example, the bit 112 may be a drill bit suitable for drilling the earth formation 104. Example types of drill bits used for drilling earth formations are fixed-cutter or drag bits, roller cone bits, impregnated bits, or coring bits. In other embodiments, the bit 112 may be a mill used for removing metal, composite, elastomer, or other materials downhole. For instance, the bit 112 may be used with a whipstock (not shown) to mill a window into a casing lining at least a portion of the wellbore 102. The bit 112 may also be a section mill used to mill away an entire section of the casing lining at least a portion of the wellbore 102, or a junk mill used to mill away tools, plugs, cement, or other materials within the wellbore 102. Swarf or other cuttings formed by use of a mill may be lifted to surface, or may be allowed to fall downhole.

Figure 2:
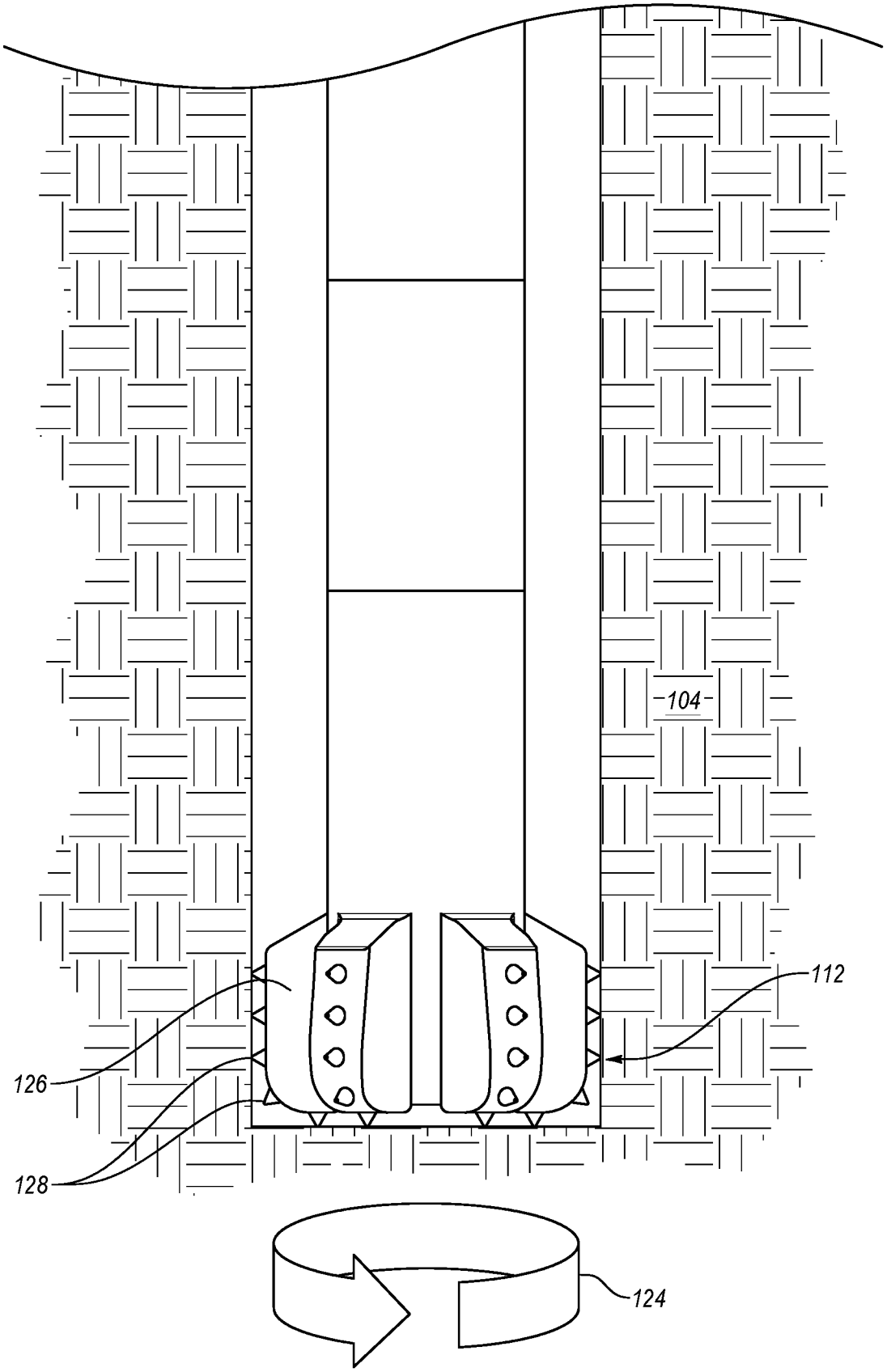
FIG. 2 is a side view of an embodiment of the bit of FIG. 1 rotating in a downhole environment, according to the present disclosure.

Referring to FIG. 2, an embodiment of a bit 112 is shown in contact with the earth formation 104. The bit 112 may rotate relative to the earth formation 104 in a first rotational direction 124. The bit 112 may include a plurality of blades 126 extending radially toward the earth formation 104. The blades 126 may define junk slots between the blade 126 to allow clearance for flushing or other removal of cuttings, drilling fluid, or other waste from the cutting region of the bit 112. The blades 126 may include primary and secondary blades. The blades 126 may have a plurality of cutting elements 128 positioned on the blades 126 and configured to engage the earth formation 104.

As shown in FIG. 2, at least some of the cutting elements 128 may be oriented radially away from the bit 112 and/or toward the earth formation 104 with a neutral rake. For example, at least some of the cutting elements 128 are oriented with an apex toward the earth formation 104 with little or no rake in the first rotational direction 124 (i.e., where a central axis of the cutting element is normal to the formation, e.g., having no forward rake). The rake is the angle of the cutting element in the rotational direction relative to the axial direction. In other embodiments, at least some of the cutting elements 128 may have an axis that is oriented radially away from the bit 112 and/or toward the earth formation 104 with a rake (e.g., in the first rotational direction 124) in a range of 20° to −20°. Any suitable cutting element may be used. For example, a cutting element with an axisymmetric cutting surface, such as a conical cutting element may be used. In some embodiments, the cutting elements described in U.S. Pat. No. 8,109,349 may be used, where the generally conical cutting elements may have concave or convex side surfaces, apexes having various radii of curvature, various thicknesses at the apex, and the like. In some embodiments, the cutting elements described in U.S. Pat. No. 8,960,337 may be used, where the cutting elements are not axisymmetric and have a chisel-like geometry, are angled conical elements, or the like. The entire disclosures of U.S. Pat. Nos. 8,109,349 and 8,960,337 are incorporated herein by reference. In addition, any suitable cutter may be used, for example, shear cutters (polycrystalline diamond compacts having a planar top surface) may be placed on opposite sides of a blade or otherwise configured so that a bit may drill in both directions.

The bit 112 is rotated in the first rotational direction 124 to engage the cutting elements 128 with the earth formation 104 and degrade (e.g., loosen and/or remove) material from the earth formation 104. For example, the bit 112 may engage with the earth formation 104 and degrade the integrity of a portion of the earth formation 104. In some examples, the degraded portion of the earth formation 104 may be removed by the bit 112. In other examples, the degraded portion of the earth formation 104 may be removed by another aspect of the drilling system such as the drilling fluid. The cutting elements 128 may degrade material in the earth formation 104 that is then carried away by the drilling fluid. The rotational speed of the bit 112 is at least partially dependent on a drive torque provided to the bit 112 from the drill string, as shown in FIG. 1, and the interaction of the bit 112 with the earth formation 104. For example, the drive torque provided to the bit 112 may be constant, but a counteractive torque on the bit 112 by engagement of the blades 126 and/or cutting elements 128 with the earth formation 104 may change, altering the rotational velocity of the bit 112. In some embodiments, energy may build in the drill string due at least partially to the counteractive torque applied to the bit 112 by the earth formation 104, similar to a torsional spring. For example, the bit 112 may encounter a harder portion of the earth formation 104, which may resist movement of the bit 112 more than other portions of the earth formation 104, slowing the rotation of the bit relative to another portion of the drill string. The harder portion of the earth formation 104 may be degraded unevenly, resulting in ledges, pockets, catches, or other uneven surfaces that provide points on which the cutting elements 128 may catch, further slowing the rotation of the bit relative to another portion of the drill string.

The energy stored in the drill string may be released by the bit 112 (i.e., the blades 126 and/or cutting elements 128) momentarily disengaging with the earth formation 104 and "slipping" relative to the earth formation 104 (e.g., experiencing stick-slip events with the earth formation 104). Slipping is the release of the energy stored in the torsion of the drill string via sudden high rotational velocity of the bit 112 and drill string in comparison to a lower rotational input velocity. Slipping can dissipate energy input to the drill string, thereby wasting energy and time in the drilling process. Slipping can also result in the bit 112 or other parts of the drill string rotating at high velocities, which may risk damage to components of the drilling system and/or operators.

In some embodiments, slipping can be reduced or mitigated by one or more techniques described herein that may reduce energy storage in the torsion of the drill string. A percentage of the stored energy stored in the torsion of the drill string may be released by reversing direction of the drive torque and/or rotational direction of the bit 112. For example, a bit 112 that is rotated in a first rotational direction 124 may begin to build up stored energy in the drill string. At least a portion of the stored energy stored in the torsion of the drill string may be released by rotating the bit 112 in a second rotational direction 130, shown in FIG. 3, opposite the first rotational direction 124 shown in FIG. 2. The percentage of the stored energy released by one or more techniques described herein may be in a range having an upper value, a lower value, or upper and lower values including any of 1%, 5%, 10%, 20%, 30%, 40%, 50%, 75%, or 100%. For example, the percentage of the stored energy released by one or more techniques described herein may be greater than 1%. In other examples, percentage of the stored energy released by one or more techniques described herein may be in a range between 1% and 100%. This is beneficial that the energy may be dissipated by the procedures described herein rather than via slip or whirl or other damaging stored energy releases.

Figure 3:
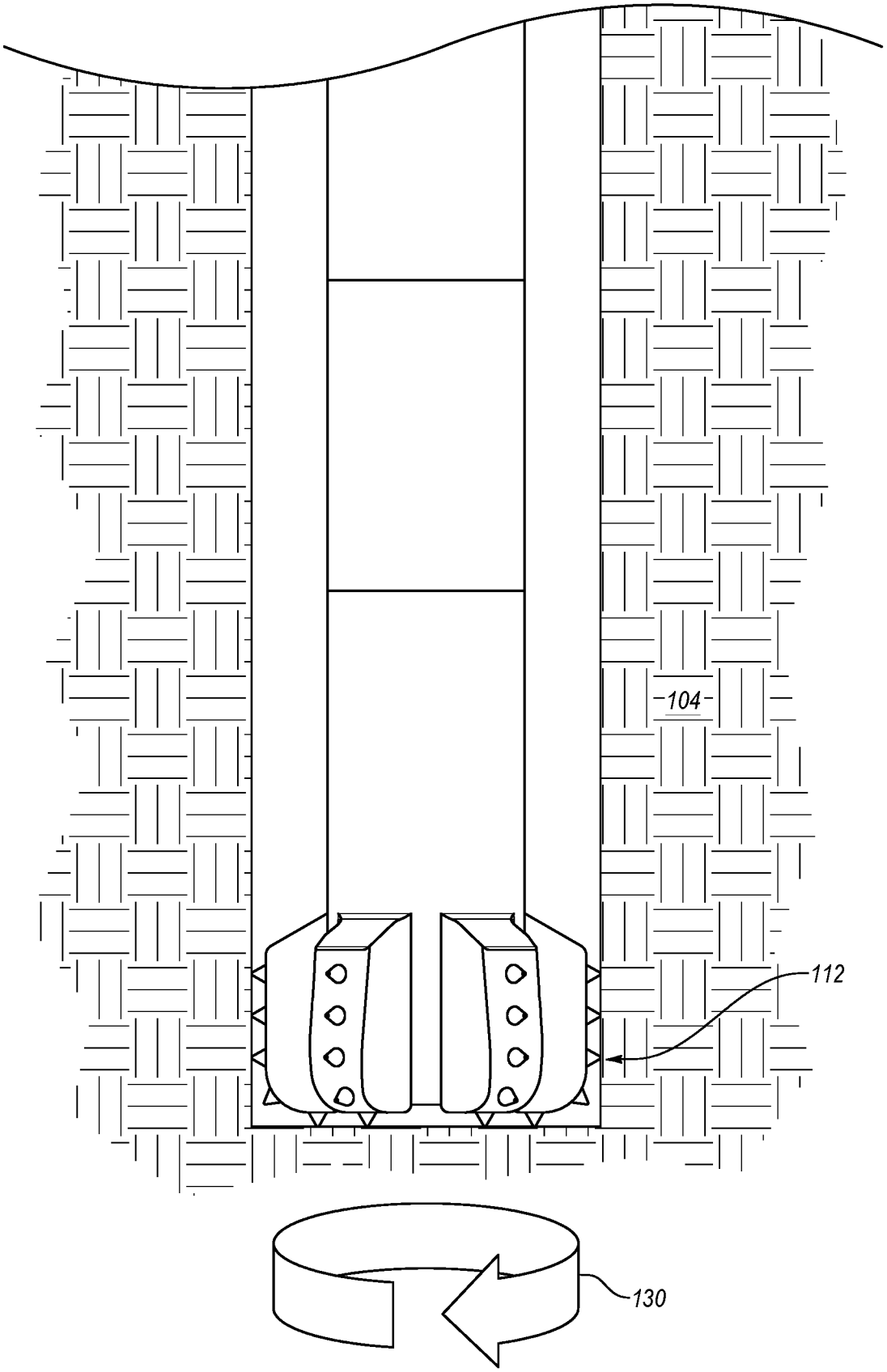
FIG. 3 is a side view of an embodiment of the bit of FIG. 1 rotating in an opposite direction of FIG. 2, according to the present disclosure.

FIG. 3 illustrates rotation of the bit 112 in a second rotational direction 130. Rotation of the bit 112 in the second rotational direction 130 relative to the earth formation 104 may remove material from the earth formation 104 by applying force to the earth formation 104 with the bit 112 in the direction opposite that of the first rotational direction. Reversing the rotational direction and applying force to the earth formation 104 in the opposite direction may remove at least some of the ledges, pockets, catches, or other uneven surfaces on the end of the wellbore. The uneven surfaces may provide locations at which the bit 112 may engage with the earth formation too aggressively and allow the earth formation 104 to apply a counteractive torque to the bit 112 and drill string that may result in stick-slip behavior.

For example, the bit 112 may encounter a harder portion of the earth formation during rotation in the first rotational direction shown in FIG. 2. During repeated revolutions of the bit 112 relative to the earth formation 104, the harder portion may resist the rotation of the bit 112 and/or cause an uneven surface to be cut by the bit 112, providing more locations at which the bit 112 may "catch" on the earth formation 104. Periodic reversal of the rotational direction (i.e., changing from the first rotational direction 124 to the second rotational direction 130 and back to the first rotational direction 124) may prevent torsional energy from building up in the drill string or may reduce the overall torsional energy built up in the drill string.

Figure 4:
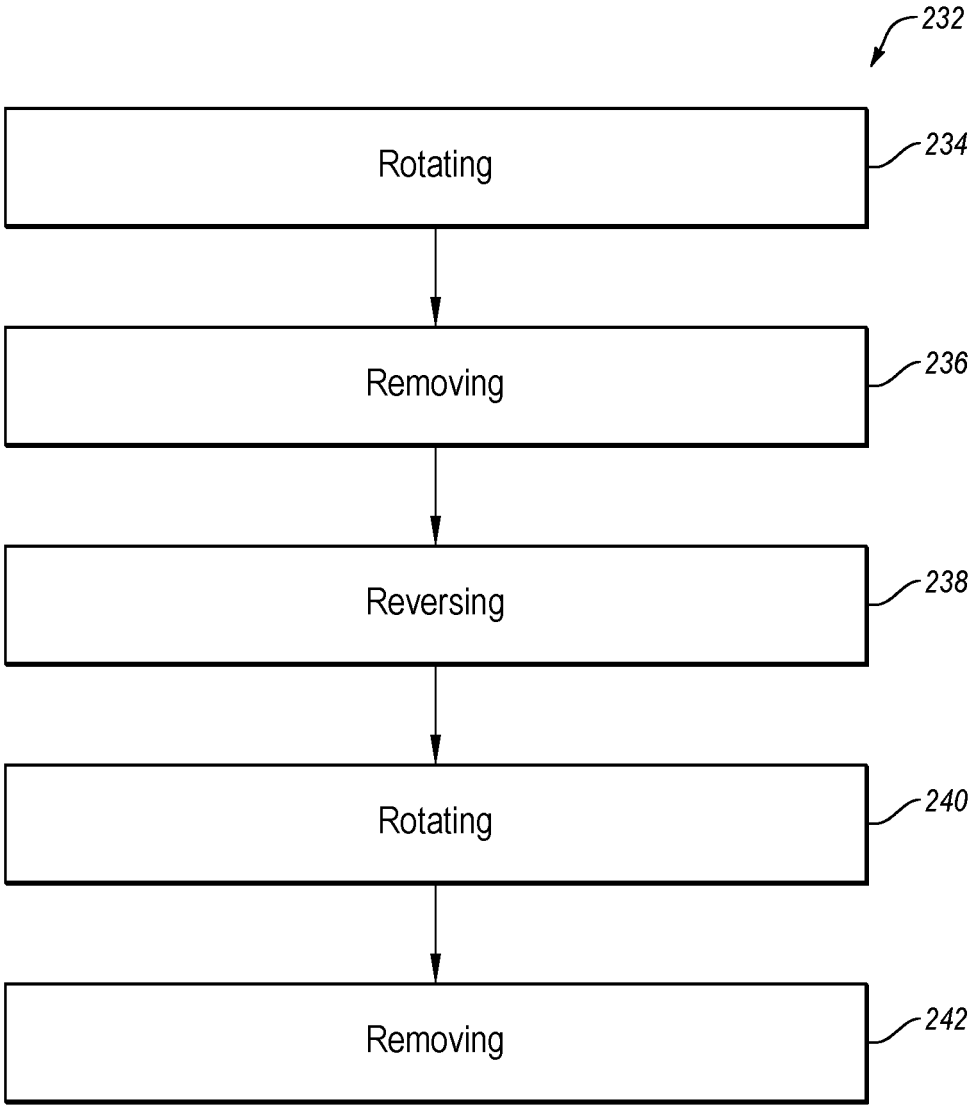
FIG. 4 is a flowchart illustrating an embodiment of a method of rotating a bit, according to the present disclosure.

FIG. 4 is a flowchart illustrating an embodiment of a method 232 of removing material from an earth formation. The method 232 includes rotating 234 a bit in a first rotational direction for a first duration of time and removing 236 material from the formation. In some embodiments, the bit may be a drill bit, such as bit 112 described in relation to FIG. 2 and FIG. 3, and may remove material from an earth formation to extend the overall length of a wellbore. In other embodiments, the bit may be a mill or other bit that may remove material from the walls of a wellbore or from casing in a wellbore.

The method 232 includes reversing 238 the bit to change the direction of rotation from the first rotational direction to a second rotational direction. The method 232 further includes rotating 240 the bit in the second rotational direction for a second duration and removing 242 material from the formation. In some embodiments, the first rotational direction may be clockwise when viewed facing downhole, and the second rotational direction may be counterclockwise when viewed facing downhole. In other embodiments, the first rotational direction may be counterclockwise when viewed facing downhole, and the second rotational direction may be clockwise when viewed facing downhole.

In some embodiments, the first duration may be longer than the second duration. For example, the bit may rotate in the first rotational direction for 30 seconds before rotating in the second rotational direction for 20 seconds. In other embodiments, the first duration may be shorter than the second duration. For example, the bit may rotate in the first rotational direction for 20 seconds before rotating in the second rotational direction for 30 seconds. In yet other embodiments, the first duration and the second duration may be equivalent. For example, the bit may rotate in the first rotational direction for 30 seconds before rotating in the second rotational direction for 30 seconds.

Figure 5:
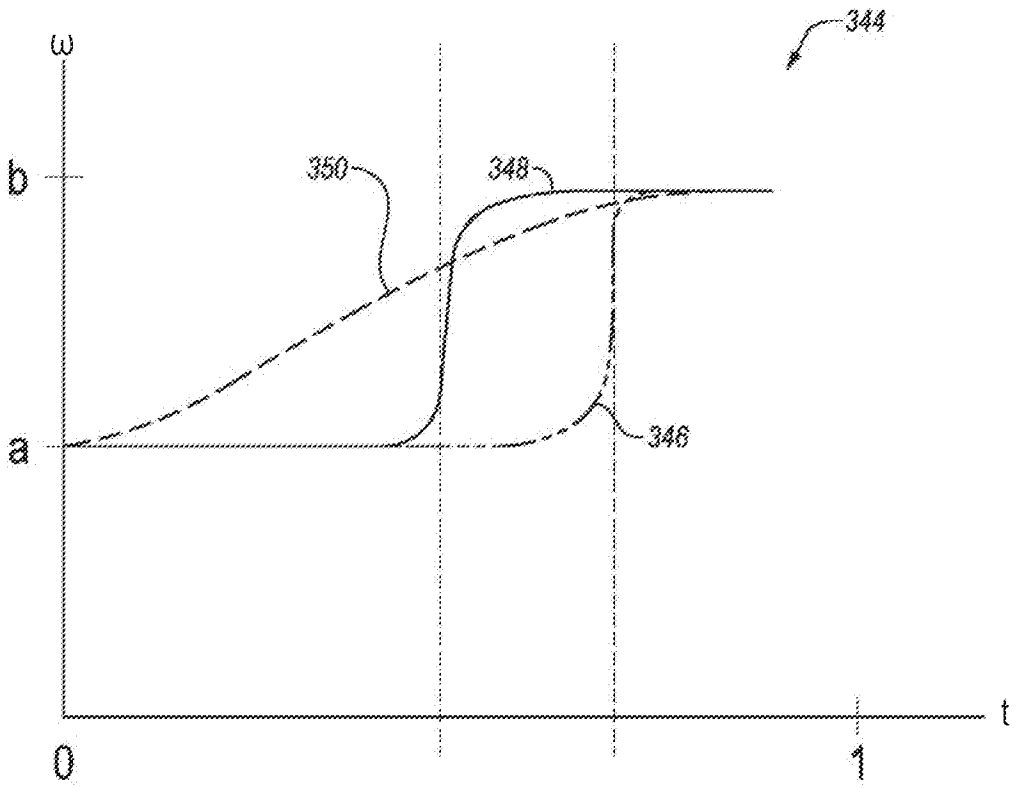
FIG. 5 is a chart depicting embodiments of ramping profiles according to the present disclosure.

The rotational acceleration and/or velocity of the bit may change, vary, etc. when rotating 234 the bit in the first rotational direction, reversing 238 the direction of rotation of the bit, and rotating 240 the bit in the second rotational direction may vary depending on the material and/or bit. For example, FIG. 5 is a chart illustrating different ramping profiles for the rotation of the bit.

A ramping profile of the rotation of bit may be described by the following equation:

$$f(t) = \frac{a * e^{cr} + b * e^{rt}}{e^{cr} + e^{rt}}$$

Where a and b are the minimum and maximum values, respectively, of the rotational velocity at the start and/or end of the ramping profile; r is the slope of the profile (i.e., a ramping rate); c is a time shift, and t is time.

For example, FIG. 5 illustrates a chart 344 with a first ramping profile 346, a second ramping profile 348, and a third ramping profile 350. The values of a and b are held constant in each example. The first ramping profile 346 and second ramping profile 348 are equivalent except the first ramping profile 346 has a greater value of c than the second ramping profile 348. The third ramping profile 350 has a lower value for r, resulting in a more gradual ramping profile to accelerate the bit more slowly. The ramping profile of a rotational velocity profile of a bit may be varied by varying the values in the equation presented herein.

In other embodiments, a ramping profile for rotation of the bit may be modeled by a Fourier series, such as:

$$f(t) = a_0 + \sum_{n=1}^{\infty}\left(a_n \cos\frac{n\pi t}{L} + b_n \sin\frac{n\pi t}{L}\right)$$

which may be simplified to a frequency domain representation:

$$f(t) = \sum_{n=1}^{\infty} A_n e^{i\frac{2\pi nt}{L}}$$

where:

$$A_n = 1/L\int_{-\frac{L}{2}}^{\frac{L}{2}} f(t)e^{-i\frac{2\pi nt}{L}}$$

Wherein L is the length of the period of the periodic movement, and t is time.

Figures 1, 6:
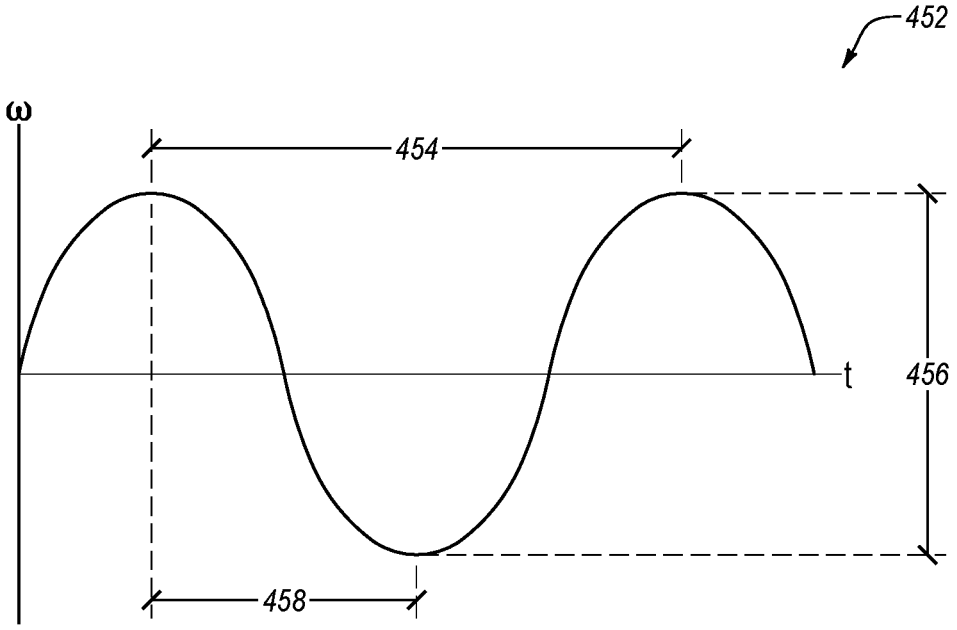
Figures 2, 6:
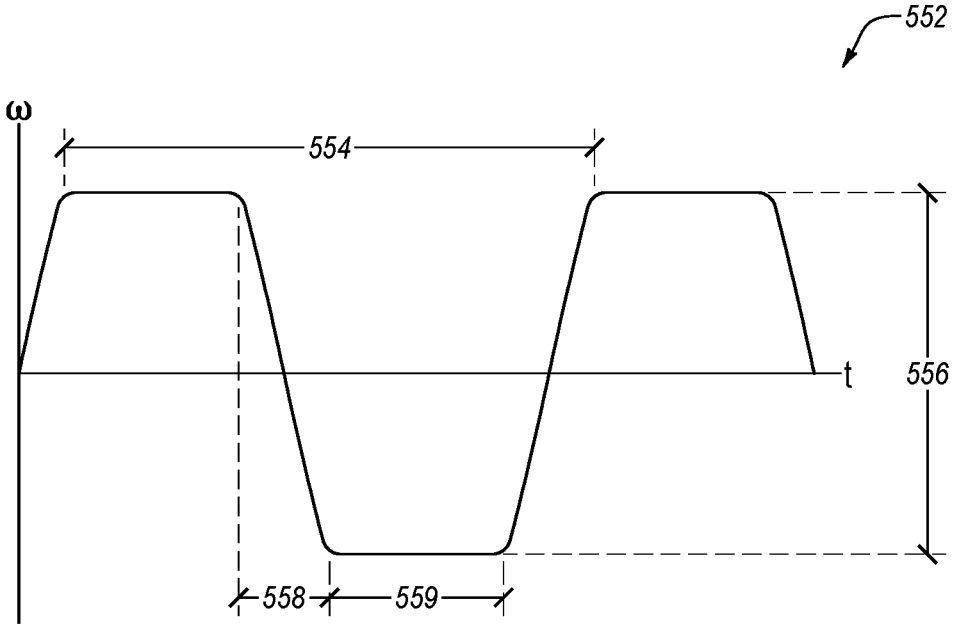

FIG. 6-1 and FIG. 6-2 are charts illustrating different rotational velocities (w) of a bit (e.g., bit 112 of FIGS. 2-3) over time (t). FIG. 6-1 illustrates a rotational velocity profile 452 of a bit relative to an amount of time. The rotational velocity profile 452 has a total period 454 of the rotational movement of the bit. The total period 454 is the amount of time between similar positions in the rotational velocity profile 452 after a directional change (i.e., points where the rotational velocity profile 452 begins to repeat). For example, the rotational velocity profile 452 shown in FIG. 6-1 has a substantially sinusoidal shape in which the bit begins decelerating upon reaching a maximum rotational velocity in either direction. In such an example, the total period 454 may be the time period between the maximum velocities in the same rotational direction. In some examples, the total period 454 may be measured between points where the bit has a zero rotational velocity and has, e.g., the same angular acceleration.

In some embodiments, the total period 454 may be in a range having an upper value, a lower value, or an upper and lower value including any of 5 seconds (s), 10 s, 15 s, 20 s, 30 s, 35 s, 40 s, 45 s, 50 s, 55 s, 60 s, 90 s, 120 s, or any values therebetween. For example, the total period 454 may be greater than 10 s. In other examples, the total period 454 may be greater than 20 s. In yet other examples, the total period 454 may be greater than 30 s. In some examples, the total period 454 may be less than 120 s. In other examples, the total period 454 may be less than 90 s. In yet other examples, the total period 454 may be less than 60 s. In some examples, the total period 454 may be between 10 s and 120 s. In other examples, the total period 454 may be between 15 s and 90 s. In yet other examples, the total period 454 may be between 20 s and 60 s.

The rotational velocity profile 452 of a bit has an amplitude 456 of the rotational velocity. The amplitude 456 is the change from the maximum rotational speed in a first rotational direction to the maximum rotational speed in the second rotational direction (i.e., net change in rotational velocity). In some embodiments, the amplitude 456 of the rotational velocity profile 452 is in a range having an upper value, a lower value, or an upper and lower value including any of 50 revolutions per minute (RPM), 100 RPM, 150 RPM, 200 RPM, 250 RPM, 300 RPM, 350 RPM, 400 RPM, 450 RPM, 500 RPM, 600 RPM, 700 RPM, 800 RPM, 900 RPM, 1000 RPM, or any values therebetween. For example, the amplitude 456 may be greater than 50 RPM. In other examples, the amplitude 456 may be less than 1000 RPM. In yet other examples, the amplitude 456 may be between 50 RPM and 1000 RPM. In further examples, the amplitude 456 may be between 100 RPM and 800 RPM. In yet further examples, the amplitude 456 may be between 200 RPM and 500 RPM.

The rotational velocity profile 452 of a bit has a ramp time 458 of the rotational velocity. The ramp time 458 is the period of time the bit takes to change from the maximum rotational speed in a first rotational direction to the maximum rotational speed in the second rotational direction (i.e., time to pass through an entire net change in rotational velocity). In some embodiments, the ramp time 458 is in a range having an upper value, a lower value, or an upper and lower value including any of 1 s, 2 s, 3 s, 4 s, 5 s, 10 s, 15 s, 20 s, 30 s, 35 s, 40 s, 45 s, 50 s, 55 s, 60 s, or any values therebetween. For example, the ramp time 458 may be may be greater than 1 s. In other examples, the ramp time 458 may be greater than 2 s. In yet other examples, the ramp time 458 may be greater than 5 s. In some examples, the ramp time 458 may be less than 60 s. In other examples, the ramp time 458 may be less than 55 s. In yet other examples, the ramp time 458 may be less than 50 s. In some examples, the ramp time 458 may be between 1 s and 60 s. In other examples, the ramp time 458 may be between 2 s and 50 s. In yet other examples, the ramp time 458 may be between 3 s and 20 s.

FIG. 6-2 illustrates another embodiment of a rotational velocity profile 552 of a bit over time (t). In the depicted embodiment, the rotational velocity profile 552 has a holding time 559 after and/or before each ramp time 558. The holding time 559 may be a period of time in the rotational velocity profile 552 during which the rotational velocity of the bit is substantially constant. For example, the rotational velocity of the bit may vary during the holding time 559 but remain within 10%, 5%, 3%, or 1% of a predetermined or set rotational velocity. In at least one embodiment, the predetermined or set rotational velocity is the maximum rotational speed in each rotational direction (that also defines the amplitude 556).

In some embodiments, the holding time 559 is in a range having an upper value, a lower value, or an upper and lower value including any of 1 s, 2 s, 3 s, 4 s, 5 s, 10 s, 15 s, 20 s, 30 s, 35 s, 40 s, 45 s, 50 s, 55 s, 60 s, or any values therebetween. For example, the holding time 559 may be greater than 1 s. In other examples, the holding time 559 may be greater than 2 s. In yet other examples, the holding time 559 may be greater than 5 s. In some examples, the holding time 559 may be less than 60 s. In other examples, the holding time 559 may be less than 55 s. In yet other examples, the holding time 559 may be less than 50 s. In some examples, the holding time 559 may be between 1 s and 60 s. In other examples, the holding time 559 may be between 2 s and 50 s. In yet other examples, the holding time 559 may be between 3 s and 40 s.

The total period 554 of the rotational velocity profile 552 shown in FIG. 6-2 is the time to cycle through one iteration of the rotational velocity profile 552. For example, the total period 554 is the sum of a first holding time, a first ramp time, a second holding time, and a second ramp time. The first holding time may have a first duration, the first ramp time may have a second duration, the second holding time may have a third duration, and the second ramp time may have a fourth duration. In some embodiments, and as shown in FIG. 6-2, the first duration and the third duration (i.e., the first ramp time and second ramp time) may be substantially equivalent. In other embodiments, the first duration and third duration may be different. In some embodiments, and as shown in FIG. 6-2, the second duration and the fourth duration (i.e., the first holding time and second holding time) may be substantially equivalent. In other embodiments, the second duration and fourth duration may be different.

In other embodiments, the holding time 559 may be of an indeterminate or variable duration. For example, the bit may continue to rotate during the holding time 559 at a substantially constant velocity until a trigger is detected to prompt reversing the direction of rotation (such as reversing 238 as described in relation to FIG. 4). The trigger may include the rotational velocity of the bit changing by more than the threshold described in relation to the rotational velocity profile 552. For example, a drop in the rotational velocity of the bit from the predetermined or set rotational velocity of more than 1%, 3%, 5%, 10%, or 20% may indicate the earth formation is slowing the rotation of the bit, and reversing the direction of the bit may release the energy stored in the torsion of the drill string without significant stick-slip. In another example, an increase in the rotational velocity of the bit from the predetermined or set rotational velocity of more than 1%, 3%, 5%, 10%, or 20% may indicate the bit is disengaging from the earth formation and is beginning to slip. Again, reversing the direction of the bit may release the energy stored in the torsion of the drill string without significant stick-slip. The change in rotational velocity may suggest that stick slip is beginning to or actually occurring, and in some embodiments, the change in direction may reduce or mitigate the impact of the stick-slip.

Figure 7:
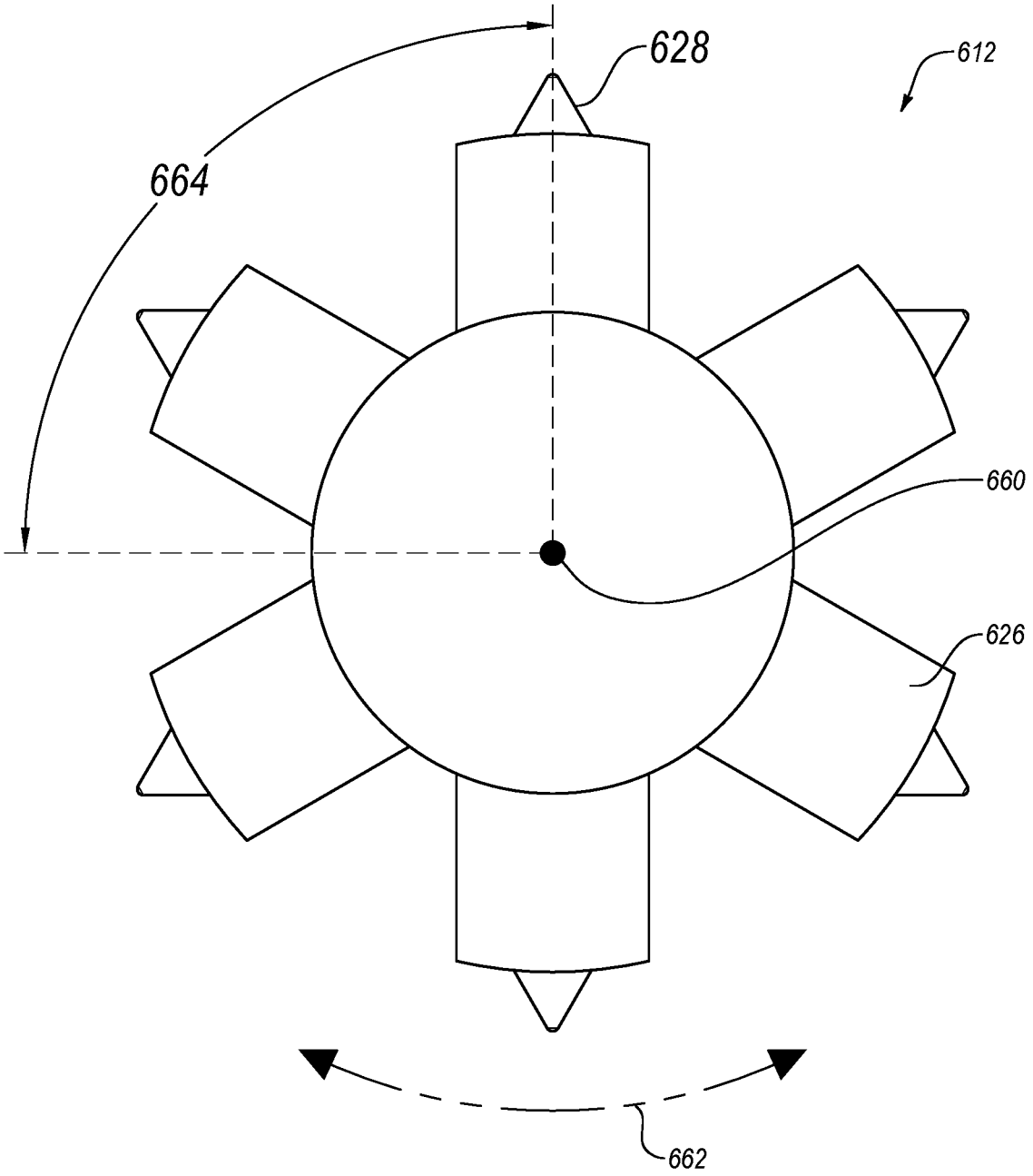
FIG. 7 is an end view of an embodiment of a bit rotating through an angle of rotation; according to the present disclosure.

In some embodiments, comparatively short periods of rotation in each rotational direction may be used. FIG. 7 illustrates an embodiment of a bit 612 oscillating through an angle of rotation. The bit 612 includes a plurality of blades 626, and the blades 626 have cutting elements 628 positioned thereon. The cutting elements 628 move when the bit 612 rotates about a rotational axis 660 in an oscillating rotational direction 662. To ensure the cutting elements 628 remove material evenly from the surrounding area, the bit 612 may rotate through a rotational angle 664 at least the angular size of the space between blades 626 before reversing direction and rotating the opposite direction. In various embodiments, the rotational angle 664 may be at least 60°, 90°, 120°, 180°, 240°, 270°, or 360°. In some embodiments, the bit may rotate for longer periods, as described above, and therefore will rotate numerous times before reversing direction. For example, the bit may rotate at least 5, 10, 20, 30, 40, 50 or 100 times before reversing direction.

Figure 8:
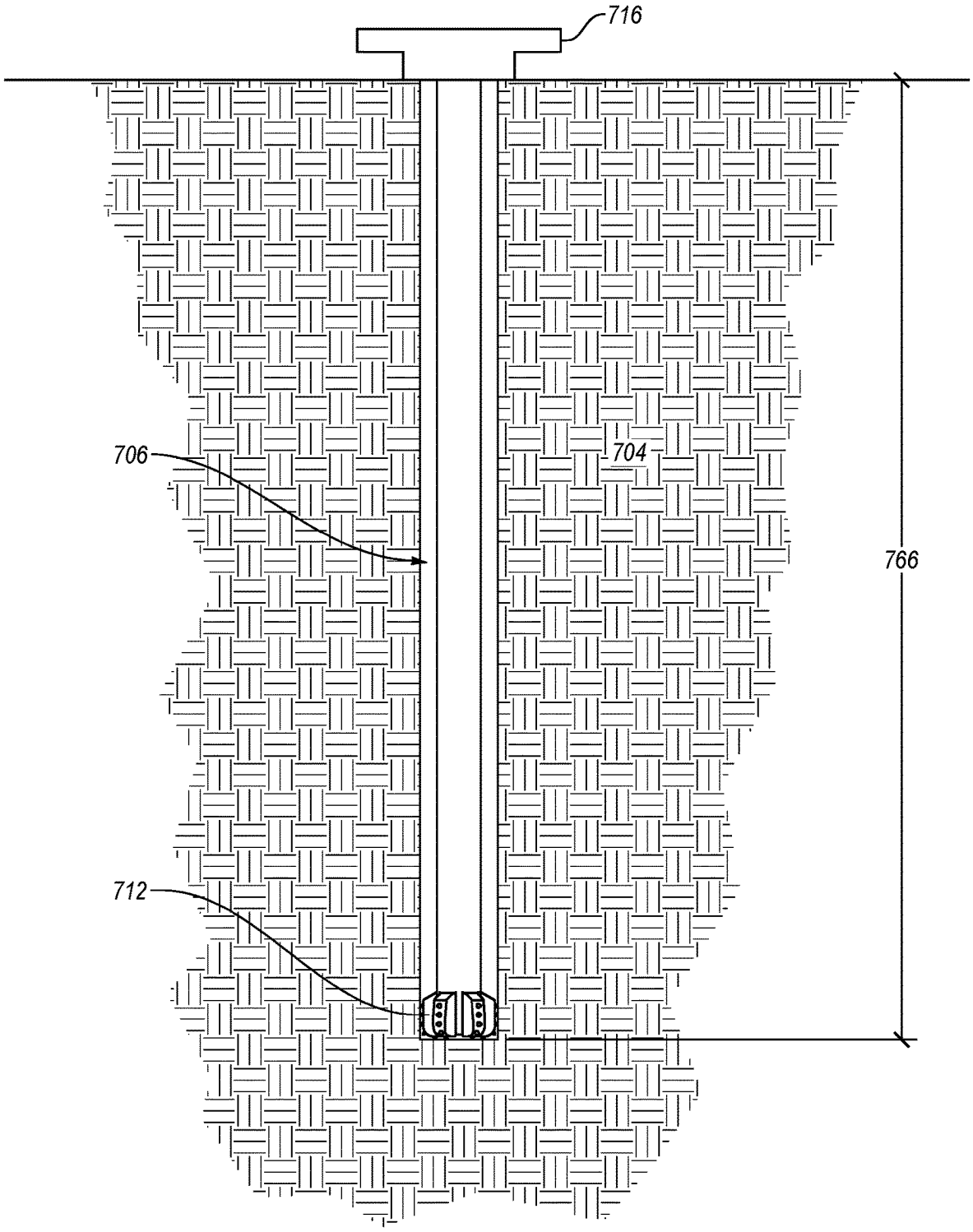
FIG. 8 is a schematic representation of an embodiment of a drilling tool assembly rotated by a kelly, according to the present disclosure.

FIG. 8 illustrates an embodiment of a bit 712 rotated by a drive torque applied by a kelly/top drive 716. The kelly/top drive 716 may rotate and provide a drive torque. The drilling tool assembly 706 may transmit the torque downhole toward the bit 712. Because the drilling tool assembly 706 is at least partially elastically deformable, the drilling tool assembly 706 may twist between the portion at which the kelly/top drive 716 provides the drive torque and the bit 712 in contact with the earth formation 704. In particular, the body length 766 of the drilling tool assembly 706 between the portion at which the kelly/top drive 716 provides the drive torque and the bit 712 in contact with the earth formation 704 may define a torsional spring that may store energy imparted by the drive torque.

In some embodiments, alternately applying a drive torque with the kelly/top drive 716 to the drilling tool assembly 706 in a first rotational direction and in an opposing second rotational direction may cause the elastic drilling tool assembly 706 to oscillate along the body length 766. The oscillations may be approximated as an uncoupled torsional oscillator. The drilling tool assembly may oscillate in different modes depending at least on the body length 766 and the mass of the drilling tool assembly 706. The various modes may rotate the bit 712 in a repeating oscillatory fashion relative to the earth formation 704.

Figure 9:
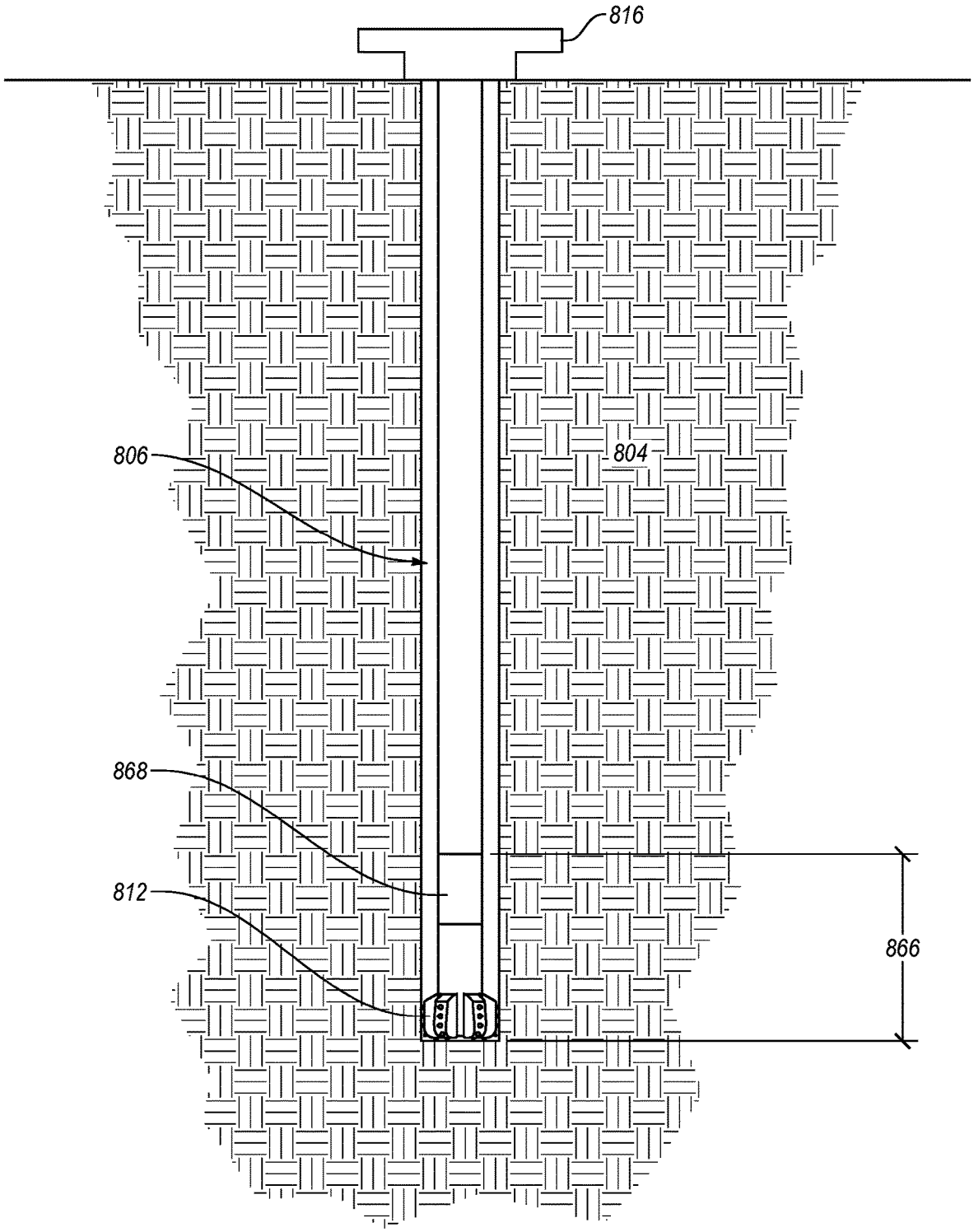
FIG. 9 is a schematic representation of an embodiment of a drilling tool assembly rotated by a downhole motor, according to the present disclosure.

FIG. 9 illustrates an embodiment including a top drive or Kelley 816 for rotating the drill string and a bit 812 further rotated by a drive torque applied by a downhole motor 868. A downhole motor 868, such as a mud motor, a turbine, an electric motor, or other downhole motor, may allow for the drive torque to be applied closer to the bit 812 near the downhole portion of the drilling tool assembly 806. The body length 866 of the drilling tool assembly 806 between the bit 812 and the downhole motor 868 is less than the body length between the bit and the top drive/kelly (such as described in relation to FIG. 8). The shorter body length 866 allows more direct transfer of drive torque from the downhole motor 868 to the bit 812 with less torsional spring effects through the body length 866 when the bit 812 interacts with the earth formation 804.

Figure 10:
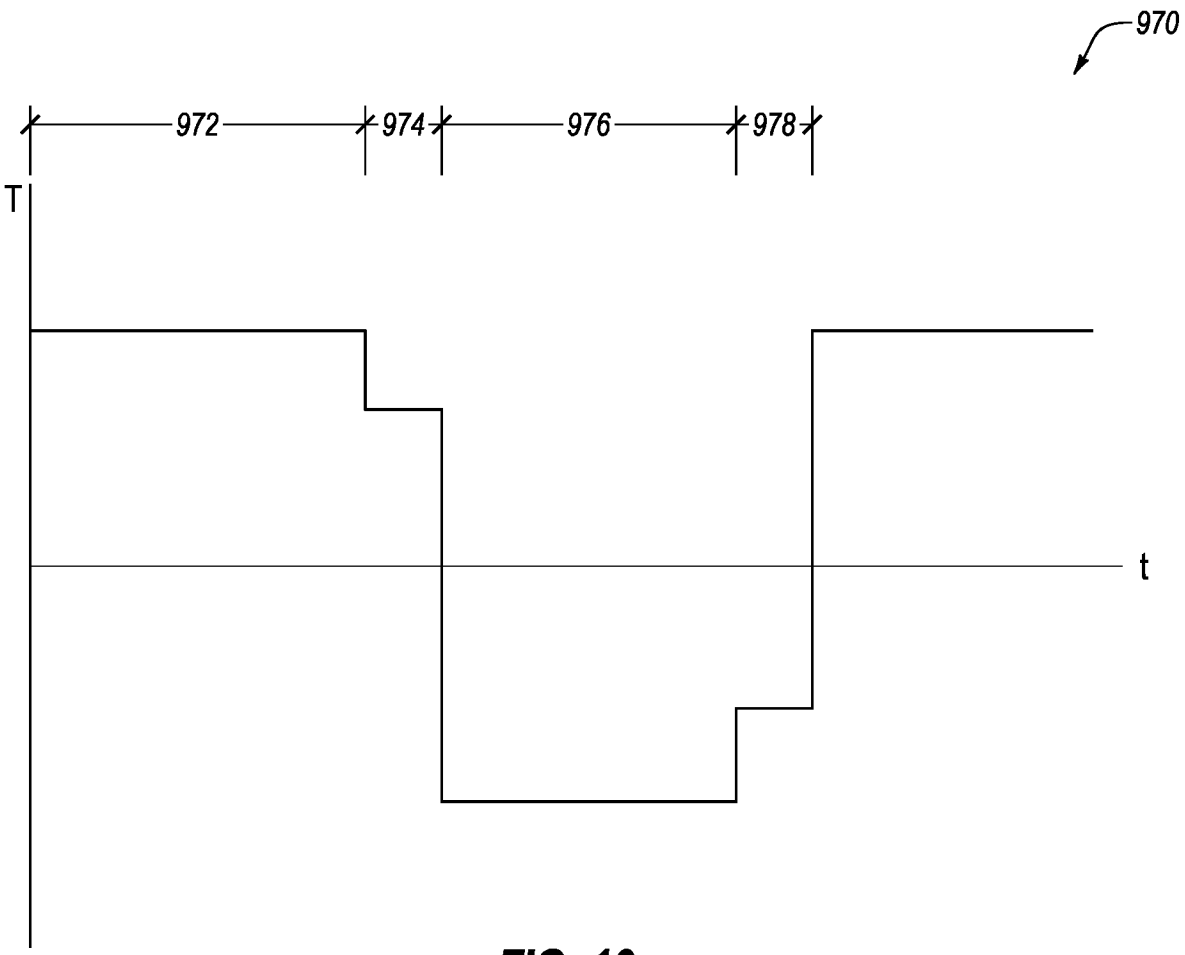
FIG. 10 is a chart of an embodiment of a torque profile; according to the present disclosure.

FIG. 10 illustrates an embodiment of a torque profile 970 for applying a drive torque to a drill string. In some embodiments, a torque profile 970 includes a first torque applied for a first duration 972, a second torque applied for a second duration 974, a third torque applied for a third duration 976, and a fourth torque applied for a fourth duration 978. In some embodiments, the first torque may vary over time. For example, the first torque may increase and/or decrease during the first duration 972. In other embodiments, the first torque may be constant during the first duration 972, as shown in FIG. 10.

In some embodiments, the second torque may vary over time. For example, the second torque may increase and/or decrease during the second duration 974. In other embodiments, the second torque may be constant during the second duration 974, as shown in FIG. 10. In some embodiments, the third torque may vary over time. For example, the third torque may increase and/or decrease during the third duration 976. In other embodiments, the third torque may be constant during the third duration 976, as shown in FIG. 10.

In some embodiments, the fourth torque may vary over time. For example, the fourth torque may increase and/or decrease during the fourth duration 978. In other embodiments, the fourth torque may be constant during the fourth duration 978, as shown in FIG. 10.

In other embodiments, one or more of the torques (first torque, second torque, third torque, fourth torque) may vary from one period to another. For example, the first torque may be constant in the first duration of a first period and a first torque may vary during a first duration in a second period. In other examples, the first torque may be the same from a first period to a second period while the first duration may vary from a first period to a second period.

In some embodiments, the first torque and the second torque may be oriented in the same direction. In some embodiments, the third torque and the fourth torque may be oriented in the same direction. In some embodiments, the first torque and the second torque may be substantially equivalent. In other embodiments, the first torque may be greater than the second torque. In some embodiments, the third torque and the fourth torque may be substantially equivalent. In other embodiments, the third torque may be greater than the fourth torque.

In some embodiments, the first torque may correspond to a ramp time, as described in relation to FIG. 6-1 and FIG. 6-2. The first torque applied during the first duration 972 and the ramp time described in relation to FIG. 6-2 may be temporally offset. For example, the first torque may be applied uphole of the bit for an amount of time before the bit at the downhole end of the drilling tool assembly is affected by the first torque. For example, in a 5,000-foot-long drilling tool assembly, there may be a delay of, e.g., more than 4 s before the energy is transmitted to the bit. In at least one embodiment, applying the first torque to the drilling tool assembly includes rotating a portion of the drilling tool assembly relative to the bit. In some embodiments, the second torque may correspond to a holding time, as described in relation to FIG. 6-1 and FIG. 6-2. For example, while the second torque is applied to the drilling tool assembly, the rotational velocity of different portions of the drilling tool assembly may be similar or the same. In other words, an uphole portion of the drilling tool assembly may rotate at a rotational velocity that is within 1%, 3%, 5%, or 10% of the rotational velocity of the bit.

As shown in FIG. 10, the torque profile 970 may include substantially constant torque values during each duration 972, 974, 976, 978. For example, the drive torque may vary during each duration 972, 974, 976, 978 but remain within 10%, 5%, 3%, or 1% of a predetermined drive torque. In other embodiments, at least one of the durations 972, 974, 976, 978 may have a torque curve with a positive slope. In yet other embodiments, at least one of the durations 972, 974, 976, 978 may have a torque curve with a negative slope.

In some embodiments, reversing the direction of the drive torque from the second torque to the third torque may be at least partially related to detecting the occurrence of one or more trigger conditions. For example, the second torque may be applied for the second duration 974, where the second duration 974 is an indeterminate period of time. The third torque (and associated reversal of direction) may be applied when a disparity in torque is detected in the drilling system. For example, the drive torque may be compared to the net torque experienced by the bit during engagement with the earth formation, such as shown in FIG. 8. Without stick-slip behavior in the drilling tool assembly 706, the drive torque applied uphole of the bit 712 and the net torque between the bit 712 and the earth formation 704 (e.g., measured within the drilling tool assembly 706) will be substantially equivalent or within a known percentage. When energy begins to build up in torsion of the drilling tool assembly 706, the net torque measured in the drilling tool assembly 706 will increase.

In some embodiments, the trigger may include the net torque in the drilling tool assembly changing by more than the threshold described in relation to the torque profile 970. For example, an increase in the net torque in the drilling tool assembly relative to the drive torque of more than 1%, 3%, 5%, 10%, or 20% may indicate the earth formation is resisting the rotation of the bit, and reversing the direction of the bit may release the energy stored in the torsion of the drill string without significant stick-slip. In another example, a decrease in the net torque in the drilling tool assembly relative to the drive torque of more than 1%, 3%, 5%, 10%, or 20% may indicate the bit is disengaging from the earth formation and is beginning to slip. Again, reversing the direction of the bit may release the energy stored in the torsion of the drill string without significant stick-slip.

In other embodiments, the trigger the trigger for reversing the drive torque may include the rotational velocity of the bit changing by more than the threshold described in relation to the rotational velocity profile 552 of FIG. 6-2. For example, a drop in the rotational velocity of the bit from the predetermined rotational velocity of more than 1%, 3%, 5%, 10%, or 20% may indicate the earth formation is slowing the rotation of the bit, and reversing the direction of the bit may release the energy stored in the torsion of the drill string without significant stick-slip. In another example, an increase in the rotational velocity of the bit from the predetermined rotational velocity of more than 1%, 3%, 5%, 10%, or 20% may indicate the bit is disengaging from the earth formation and is beginning to slip. Again, reversing the direction of the bit may release the energy stored in the torsion of the drill string without significant stick-slip.

In yet other embodiments, the trigger for reversing the drive torque may include detecting a whirl RPM (i.e., the RPM of the drill string around the borehole) greater than a threshold value. For example, the drill string may exhibit whirl within the wellbore. For example, a whirl of greater than 10 RPM, 20 RPM, 30 RPM, 40 RPM, 50 RPM, 60 RPM, 70 RPM, 80 RPM, 90 RPM, 100 RPM, 110 RPM, 120 RPM, 130 RPM, 140 RPM, 150 RPM, or any values therebetween may indicate potentially damaging whirl, and reversing the direction of the bit may slow or stop the whirl behavior. In some embodiments, the trigger for reversing the direction of the bit may be the detection of reverse whirl.

In some embodiments, the torque profile 970 may have a total period in a range having an upper value, a lower value, or an upper and lower value including any of 5 seconds (s), 10 s, 15 s, 20 s, 30 s, 35 s, 40 s, 45 s, 50 s, 55 s, 60 s, 90 s, 120 s, or any values therebetween. For example, the total period may be greater than 10 s. In other examples, the total period may be greater than 20 s. In yet other examples, the total period may be greater than 30 s. In some examples, the total period may be less than 120 s. In other examples, the total period may be less than 90 s. In yet other examples, the total period may be less than 60 s. In some examples, the total period may be between 10 s and 120 s. In other examples, the total period may be between 15 s and 90 s. In yet other examples, the total period may be between 20 s and 60 s.

In at least one embodiment, a drilling system and/or drilling method according to the present disclosure may reduce the effects of stick-slip and torsional loading on a drilling tool assembly, as described herein. A drilling system and/or drilling method according to the present disclosure may increase drilling efficiency and reduce risks of damage to the drilling system and to operators of the drilling system.

Although the embodiments of drilling systems and associated methods have been primarily described with reference to wellbore drilling operations, the drilling systems and associated methods described herein may be used in applications other than the drilling of a wellbore. In other embodiments, drilling systems and associated methods according to the present disclosure may be used outside a wellbore or other downhole environment used for the exploration or production of natural resources. For instance, drilling systems and associated methods of the present disclosure may be used in a borehole used for placement of utility lines, or in a bit used for a machining or manufacturing process. Accordingly, the terms "wellbore," "borehole" and the like should not be interpreted to limit tools, systems, assemblies, or methods of the present disclosure to any particular industry, field, or environment.

References to "one embodiment" or "an embodiment" of the present disclosure are not intended to be interpreted as excluding the existence of additional embodiments that also incorporate the recited features. For example, any element described in relation to an embodiment herein is combinable with any element of any other embodiment described herein, unless such features are described as, or by their nature are, mutually exclusive. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value. Where ranges are described in combination with a set of potential lower or upper values, each value may be used in an open-ended range (e.g., at least 50%, up to 50%), as a single value, or two values may be combined to define a range (e.g., between 50% and 75%).

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. Changes that come within the meaning and range of equivalency of the claims are to be embraced within their scope.

What is claimed is:

1. A method of removing material with a bit, the method comprising:

rotating a top drive in a first rotational direction, wherein rotating the top drive in the first rotational direction includes rotating the bit in the first rotational direction for a first duration of time;

removing material from a wellbore surface for at least a portion of the first duration of time;

reversing a rotational direction of the top drive, wherein reversing the rotational direction of the top drive includes reversing the rotational direction of the bit;

rotating the top drive in a second rotational direction, wherein rotating the top drive in the second rotational direction includes rotating the bit in the second rotational direction for a second duration of time; and removing material from the wellbore surface for at least a portion of the second duration of time.

2. The method of claim 1, rotating the bit in a first rotational direction including rotating the bit less than 360°.

3. The method of claim 2, rotating the bit in a second rotational direction including rotating the bit less than 360°.

4. The method of claim 1, further comprising detecting a change in a rotational velocity of the bit before reversing the rotational direction of the bit.

5. The method of claim 4, detecting a change in the rotational velocity including detecting a reduction of at least 20% of the rotational velocity of the bit.

6. The method of claim 1, further comprising cyclically changing the bit from the first rotational direction to the second rotational direction and back to the first rotational direction for a total period, the total period including a sum of the first duration of time and the second duration of time.

7. A method of rotating a bit, the method comprising:

applying a first torque to a top of a drill string in a first rotational direction;

holding substantially the first torque for a first duration of time;

applying a second torque in the first rotational direction to the top of the drill string to mitigate stick slip, at least one of the first torque or the second torque causing a bit to rotate in the first rotational direction;

holding substantially the second torque for a second duration of time;

applying a third torque in a second rotational direction opposite to the first rotational direction to the top of the drill string in the second rotational direction;

holding substantially the third torque for a third duration of time;

applying a fourth torque in the second rotational direction to the top of the drill string, at least one of the third or the fourth torque causing the bit to rotate in the second rotational direction; and holding substantially the fourth torque for a fourth duration of time.

8. The method of claim 7, applying the first torque including rotating a first end of the portion of a drilling tool assembly relative to a second end of the drilling tool assembly.

9. The method of claim 7, applying the second torque including rotating a first end of the drilling tool assembly at a first rotational velocity and a second end of the drilling tool assembly at second rotational velocity, the second rotational velocity being within 20% of the first rotational velocity.

10. The method of claim 7, the first duration of time being less than the second duration of time.

11. The method of claim 7, the first torque being greater than the second torque.

12. The method of claim 7, the second duration of time being equivalent to the fourth duration of time.

13. The method of claim 7, a sum of the first duration of time, the second duration of time, the third duration of time, and the fourth duration of time being greater than 10 seconds.

14. The method of claim 7, further comprising detecting a trigger, and wherein the second duration of time extends until the trigger is detected.

15. The method of claim 14, wherein applying the third torque to the top of the drill string occurs after detecting the trigger.

16. The method of claim 14, wherein detecting the trigger includes detecting an increase of at least 20% of the net torque on the drill string.

17. The method of claim 14, wherein detecting the trigger includes detecting a decrease in rotational velocity of a bit at an end of the drill string.

18. A system for rotating a bit:

a drilling tool assembly, the drilling tool assembly including:

a drill string, and a bit connected at an end of the drill string, wherein the bit includes a plurality of cutting elements having a neutral rake angle; and a top drive configured to alternately apply a drive torque to the bit through the drill string in a first rotational direction and in an opposing second rotational direction.

19. The system of claim 18, the drilling tool assembly further comprising a torque meter configured to measure forces applied to the bit.

* * * * *